US012053071B1

(12) United States Patent
Schinasi

(10) Patent No.: US 12,053,071 B1
(45) Date of Patent: Aug. 6, 2024

(54) ROLLING TOTE BAG

(71) Applicant: Codefine International SA, La Tour-de-Peilz (CH)

(72) Inventor: Piero Schinasi, La Tour-de-Peilz (CH)

(73) Assignee: Codefine International SA, La Tour-de-Peilz (CH)

( * ) Notice: Subject to any disclaimer, the term of this patent is extended or adjusted under 35 U.S.C. 154(b) by 0 days.

(21) Appl. No.: 18/419,002

(22) Filed: Jan. 22, 2024

(30) Foreign Application Priority Data

Feb. 28, 2023 (EP) ..... 23159231

(51) Int. Cl.
*A45C 5/14* (2006.01)
*A45C 7/00* (2006.01)

(52) U.S. Cl.
CPC ..... *A45C 5/143* (2013.01); *A45C 7/0036* (2013.01)

(58) Field of Classification Search
CPC ..... A45C 5/143; A45C 7/0036
USPC ..... 190/40, 126; 383/2
See application file for complete search history.

(56) References Cited

U.S. PATENT DOCUMENTS 5,090,526 A * 2/1992 Jacober ..... A45C 7/0077 383/110
7,160,028 B1 1/2007 Linday
7,344,022 B2 * 3/2008 Madson ..... B65D 31/10 383/88
7,730,739 B2 * 6/2010 Fuchs ..... F25C 1/22 62/530
8,469,249 B2 6/2013 Sugano
D688,449 S 8/2013 Schinasi
9,999,282 B2 6/2018 Schinasi
10,376,030 B1 8/2019 Koh
2006/0198562 A1 * 9/2006 Mogil ..... A45C 7/0077 383/121.1
2015/0272289 A1 10/2015 Schinasi

FOREIGN PATENT DOCUMENTS

WO 2014068545 A1 5/2014

OTHER PUBLICATIONS

European Search Report; European Patent Office; European Patent Application No. 23159231.2; Jul. 11, 2023; 2 pages.
European Written Opinion; European Patent Office; European Patent Application No. 23159231.2; Jul. 11, 2023; 4 pages.
(Continued)

*Primary Examiner* — Sue A Weaver
(74) *Attorney, Agent, or Firm* — Taft Stettinius & Hollister LLP

(57) ABSTRACT

A rolling tote bag including a collapsible container body made of a foldable assembly of fabric panels, including a bottom panel and side panels, that jointly define an inner storage volume when in an expanded state. The rolling tote bag further includes a rolling support assembly to provide rolling support for the collapsible container body in the expanded state, the rolling support assembly including a support plate and a plurality of caster wheels provided on an underside of the support plate. The collapsible container body further includes a retaining structure formed of one or more fabric panels, which retaining structure is provided underneath the bottom panel and is configured to securely hold the support plate outside of the inner storage volume against an underside of the bottom panel.

21 Claims, 9 Drawing Sheets

(56) References Cited

OTHER PUBLICATIONS

International Search Report; European Patent Office; International Application No. PCT/IB2024/051823; Apr. 30, 2024; 3 pages.
Written Opinion of the International Searching Authority; European Patent Office; International Application No. PCT/IB2024/051823; Apr. 30, 2024; 5 pages.

* cited by examiner

ROLLING TOTE BAG

TECHNICAL FIELD

The present invention generally relates to a multipurpose rolling tote bag as for instance used as shopping bag, grocery bag and/or laundry bag.

BACKGROUND OF THE INVENTION

Rolling tote bags are known as such in the art.

International (PCT) Publication No. WO 2014/068545 A1 and related U.S. Pat. No. 9,999,282 B2, the contents of which are incorporated herein by reference, disclose a rolling tote bag comprising a collapsible container body made of a foldable assembly of fabric panels, including a bottom panel and side panels, that jointly define an inner storage volume when in an expanded state. This rolling tote bag further comprises a removable rolling support assembly to provide rolling support for the collapsible container body in the expanded state, the removable rolling support assembly including a support plate and a plurality of caster wheels provided on an underside of the support plate. More specifically, the rolling tote bag is constructed such that the support plate can be inserted inside the inner storage volume and be removably attached at the bottom of the collapsible container body by means of a pair of inner securing flaps. The bottom panel of the collapsible container body is furthermore provided with apertures to allow passage of the caster wheels therethrough in order to project away from the bottom panel on the underside of the collapsible container body.

A rolling tote bag embodying the aforementioned configuration is available on the market in various sizes and colours under the product designation HULKEN® (cf. https://hulkenbag.com/).

Yet another example of a similar rolling tote bag with a removable rolling support assembly is disclosed in U.S. Design Pat. No. U.S. D688,449 S, the rolling tote bag being likewise constructed such that the rolling support assembly can be inserted inside the inner storage volume and removably attached at the bottom of the collapsible container body, with the caster wheels projecting away from the bottom panel through corresponding apertures formed therein to provide rolling support for the collapsible container body.

The aforementioned solutions are reasonably satisfactory but suffer from certain limitations.

One such limitations resides in the absence of support at the four bottom corners of the tote bag, which bottom corners have a tendency to sag and drop slightly. This potentially exposes the bottom corners of the tote bag to wear and tear and, on the long run, occurrence of damages.

Another limitation resides in the required presence of the apertures in the bottom panel for allowing passage of the caster wheels, which apertures inherently introduce points of weakness in the bag structure and expose the inner storage volume to penetration of dust and other undesired foreign substances coming from the environment in which the rolling tote bag is being displaced. This also somewhat restricts the ability to use caster wheels of larger dimensions as the apertures have to be dimensioned accordingly.

U.S. Pat. No. 10,376,030 B1 discloses a rolling tote bag with a container body and an external rolling support assembly that is attached to the bottom of the container body. A bottom insert is furthermore preferably positioned inside the bag at the bottom thereof. In one embodiment, the rolling support assembly consists of a collapsible frame with articulated links that are designed to allow the collapsible frame to be folded in the width direction along with the container body, which requires prior flipping of the bottom insert to a vertical position if present. This solution is unnecessary complex and inevitably increases production costs. In another embodiment, in order to reduce manufacturing costs, the collapsible frame may be replaced by a non-collapsible fixed frame or solid platform. In any event, attachment of the rolling support assembly is merely performed by means of four fasteners such as snap fasteners. More specifically, four snap sockets are provided near each corner of the bottom of the container body, which snap sockets are designed to cooperate with a corresponding number of snap studs provided at corresponding upper locations of the collapsible or non-collapsible frame. This fastening method is not adequate from a practical perspective, especially in that each fastener is prone to be accidentally released, especially when rolling the tote bag on relatively uneven surfaces, which may cause undesired separation of the rolling support assembly from the underside of the container body. U.S. Pat. No. 8,469,249 B2 discloses a cart attachment system for a backpack including upper and lower cart attachments. More specifically, a bottom portion of the backpack is provided with the lower cart attachment that includes a pair of opposed flexible flaps that are coupled along opposite ends of the bottom portion of the backpack. An inner side of a first one of the flexible flaps is provided, at a free end, with a first hook-and-loop fastener for cooperation with a second hook-and-loop fastener that is provided on an outer side of the second flexible flap. The first and second flexible flaps form a retaining structure that is configured to hold a bottom support structure of the cart, the bottom support structure including a platform that is provided with a pair of wheel assemblies and a pair of support assemblies. The upper cart attachment is provided at an upper portion of the backpack to hold a top portion of the cart, namely a horizontal bar thereof that is attached to two upright arms that are secured at a bottom end to the bottom support structure. In other words, the lower and upper cart attachments work in conjunction to secure the cart to the backpack. This solution is relatively complex and cumbersome.

There therefore remains a need for an improved solution.

SUMMARY OF THE INVENTION

A general aim of the invention is to provide a rolling tote bag that obviates the problems and limitations of known rolling tote bags.

More specifically, an aim of the invention is to provide such a rolling tote bag that retains the functionalities and benefits of the known rolling tote bag of International (PCT) Publication No. WO 2014/068545 A1 and related U.S. Pat. No. 9,999,282 B2, while improving resistance to wear and tear and to undesired penetration of dust and foreign substances coming from the environment in which the rolling tote bag is displaced.

A further aim of the invention is to provide such a rolling tote bag that is cost-efficient to produce.

Yet another aim of the invention is to provide such a rolling tote bag that allows use of rolling support assemblies with a larger variety of caster wheels sizes.

These aims and others are achieved thanks to the solutions defined in the claims.

In accordance with the invention, there is provided a rolling tote bag comprising a collapsible container body made of a foldable assembly of fabric panels, including a bottom panel and side panels, that jointly define an inner storage volume when in an expanded state. The rolling tote bag further comprises a rolling support assembly to provide rolling support for the collapsible container body in the expanded state, the rolling support assembly including a support plate and a plurality of caster wheels provided on an underside of the support plate. According to the invention, the collapsible container body further comprises a retaining structure formed of one or more fabric panels, which retaining structure is provided underneath the bottom panel and is configured to securely hold the support plate outside of the inner storage volume against an underside of the bottom panel.

By way of preference, the retaining structure includes first and second releasable securing flaps attached to and positioned along opposite lateral ends of the bottom panel, which first and second releasable securing flaps are partially overlapping and releasably attachable to one another to encase the support plate between the bottom panel and the first and second releasable securing flaps.

In this latter context, a distal end section of the first releasable securing flap is preferably provided with a first fastening element positioned on an inner side of the first releasable securing flap, while a distal end section of the second releasable securing flap is provided with a complementary, second fastening element positioned on an outer side of the second releasable securing flap for releasable cooperation with the first fastening element.

In accordance with a particularly preferred embodiment, the retaining structure further includes third and fourth releasable securing flaps attached to and positioned along opposite longitudinal ends of the bottom panel to hold corresponding longitudinal end sections of the support plate. Furthermore, each of the third and fourth releasable securing flaps is provided with an inner fastening element positioned on an inner side thereof, while opposite longitudinal end sections of the support plate are each provided with a complementary fastening element for releasable cooperation with a corresponding one of the inner fastening elements.

In accordance with a more specific embodiment, the first and second releasable securing flaps are dimensioned to at least partly cover the third and fourth releasable securing flaps when in an assembled state. In addition, each of the third and fourth releasable securing flaps is further provided with an outer fastening element positioned on an outer side thereof, while longitudinal end sections of each of the first and second releasable securing flaps are each further provided with a complementary, inner fastening element for releasable cooperation with a corresponding one of the outer fastening elements. In this latter context, each of the first and second releasable securing flaps may further be provided with one or more apertures positioned and dimensioned to allow passage of the caster wheels therethrough. Alternatively, or in addition thereto, each of the first and second releasable securing flaps may be shaped to exhibit one or more cutouts in areas where the caster wheels are located.

In accordance with another specific embodiment, the first and second releasable securing flaps are dimensioned not to cover the third and fourth releasable securing flaps and to leave spacings that are positioned and dimensioned to accommodate passage of the caster wheels.

The fastening elements may especially consist of hook-and-loop fasteners, other types of fasteners being however conceivable.

The aforementioned first and second releasable securing flaps may especially be positioned along opposite short ends of the bottom panel. In such case, the aforementioned third and fourth releasable securing flaps are positioned along opposite long ends of the bottom panel.

In accordance with another embodiment of the invention, the retaining structure includes at least one releasable retaining panel fastened to the collapsible container body about a periphery of the bottom panel to form a releasable retaining envelope underneath the bottom panel, which releasable retaining envelope is configured and dimensioned to receive the support plate therein, while allowing passage of the caster wheels through the at least one releasable retaining panel. This releasable retaining envelope is structured to take an open state in which the at least one releasable retaining panel is at least partly released from the collapsible container body to allow the support plate to be removed from or inserted into the releasable retaining envelope and a closed state in which the at least one releasable retaining panel is fastened to the collapsible container body to securely hold the support plate within the releasable retaining envelope. By way of preference, the releasable retaining structure includes a zipper to selectively close the retaining envelope around the support plate or open the releasable retaining envelope to allow insertion or removal of the support plate.

In accordance with an advantageous variant, the collapsible container body may be configured to exhibit rounded corners.

The side panels may each be made of at least two outer pieces of fabric and an intermediate piece of bubble wrap interposed between the two outer pieces of fabric, as taught in International (PCT) Publication No. WO 2014/068545 A1 and related U.S. Pat. No. 9,999,282 B2. Furthermore, the outer pieces of fabric may be made of or comprise at least one sheet of woven fabric produced out of strands of synthetic or non-synthetic material, such as polypropylene strands, and one or each of the outer pieces of fabric may further comprise a laminated film that is laminated on an outer side of the sheet of woven fabric.

In accordance with an advantageous embodiment, opposite short side panels of the collapsible container body are each provided with a gusset fold designed to allow outward folding of the opposite short side panels into flat-folded gusset sections. In the latter context, the collapsible container body may further be configured to be foldable into a flattened configuration where the opposite short side panels are folded outward along the gusset fold into the flat-folded gusset sections, the flat-folded gusset sections being foldable inward over lateral sections of a first long side panel of the collapsible container body, while a second long side panel of the collapsible container body, opposite the first long side panel, is foldable inward to align the bottom panel and associated rolling support assembly with the second long side panel.

Further advantageous embodiments of the invention are discussed below.

BRIEF DESCRIPTION OF THE DRAWINGS

Other features and advantages of the present invention will appear more clearly from reading the following detailed description of embodiments of the invention which are presented solely by way of non-restrictive examples and are illustrated by the appended drawings in which.

DETAILED DESCRIPTION OF EMBODIMENTS OF THE INVENTION

The present invention will be described in relation to various illustrative embodiments as shown in particular in FIGS. 1 to 5. It shall be understood that the scope of the invention encompasses all combinations and sub-combinations of the features of the invention disclosed herein as defined by the appended claims.

Figure 1:
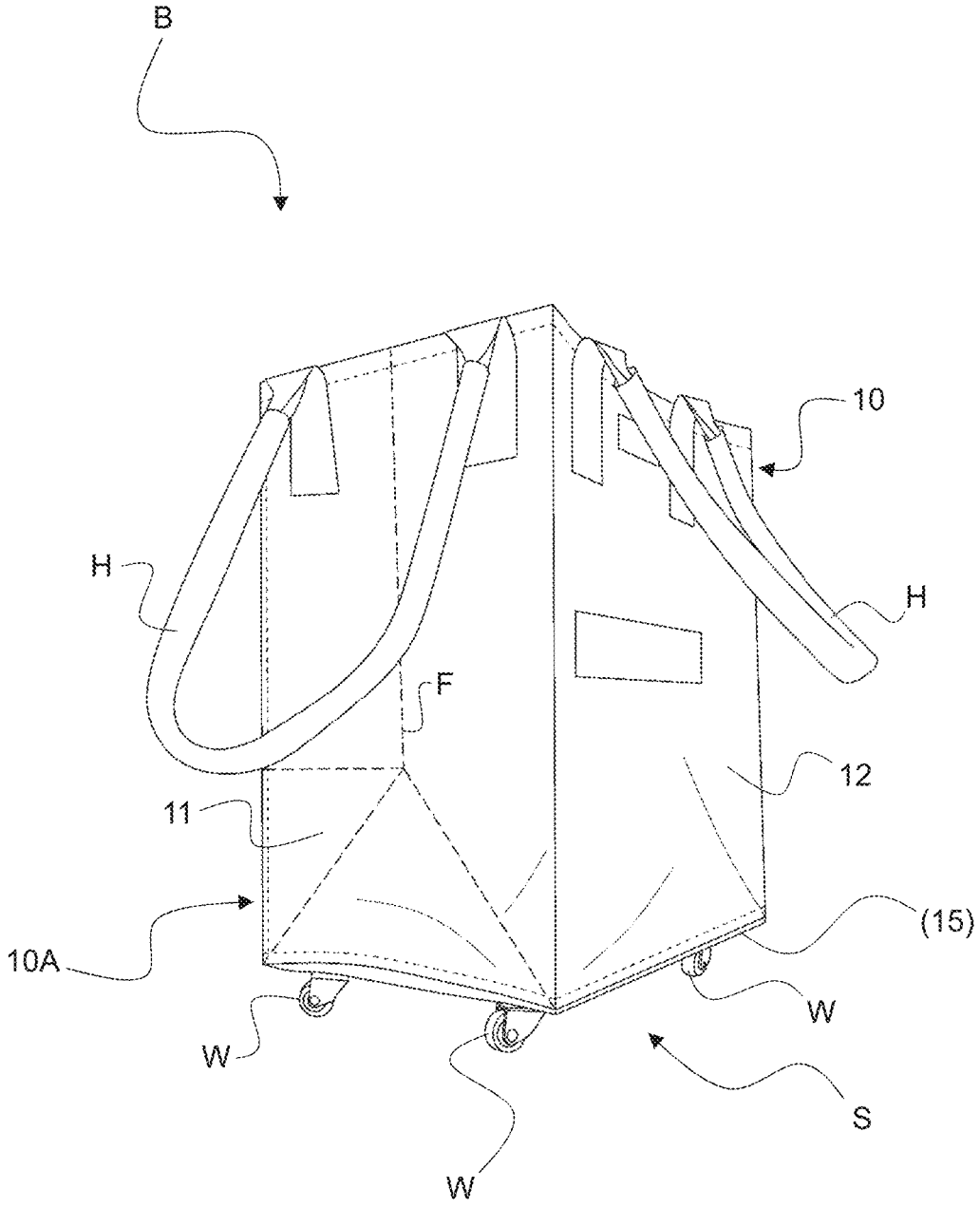
FIG. 1 is a photographic illustration of a rolling tote bag in accordance with a first embodiment of the invention.

FIG. 1 is a photographic illustration of a rolling tote bag B in accordance with a first embodiment of the invention. The rolling tote bag B comprises a collapsible container body 10 that is made of a foldable assembly of fabric panels, including a bottom panel 15 and side panels 11, 12, namely, a pair of short side panels 11 and a pair of long side panels 12. The fabric panels 11, 12, 15 jointly define an inner storage volume when in the expanded state as shown in FIG. 1. In the illustrated examples, multiple handles H are secured to the side panels 11, 12, including a pair of handles H secured to the opposite long side panels 12 (only one being visible in FIG. 1) and a third handle secured on one of the short side panels 11 to facilitate rolling of the tote bag B in use.

The rolling tote bag B further comprises a removable rolling support assembly S to provide rolling support for the collapsible container body 10 in the expanded state. The removable rolling support assembly S includes a support plate (not visible in FIG. 1 but designated by reference sign P—see also FIGS. 2A-D) and a plurality of caster wheels W provided on an underside of the support plate P.

The collapsible container body 10 is advantageously constructed such that each side panel 11, 12 is made of at least two outer pieces of fabric and an intermediate piece of bubble wrap interposed between the two outer pieces of fabric, as taught by International (PCT) Publication No. WO 2014/068545 A1 and related U.S. Pat. No. 9,999,282 B2, the contents of which are incorporated herein by reference in that regard. This provides some level of structural reinforcement to the collapsible container body 10 which can retain its expanded state, while still allowing the collapsible container body 10 to be folded to a compact configuration for storage.

The outer pieces of fabric may especially be made of or comprise at least one sheet of woven fabric produced out of polypropylene strands. Other synthetic or non-synthetic materials could however be contemplated without departing from the scope of the invention as defined by the appended claims. Preferably, one or each of the outer pieces of fabric further comprises a laminated film such as but not limited to a BOPP film, that is laminated on an outer side of the sheet of woven fabric, which allows customization of the appearance of either one or both of the external and internal visible sides of the collapsible container body 10. Lamination of a BOPP film is advantageously contemplated, but any other suitable lamination material could be contemplated, including e.g. cast polypropylene films.

The support plate P may be made of any desired material and exhibit any adequate structure. Light-weight materials and structures are preferred. In particular, the support plate P may be made of board of synthetic material including a honeycomb spacer structure that ensures adequate rigidity and strength, while remaining light-weight.

Figure 3A:
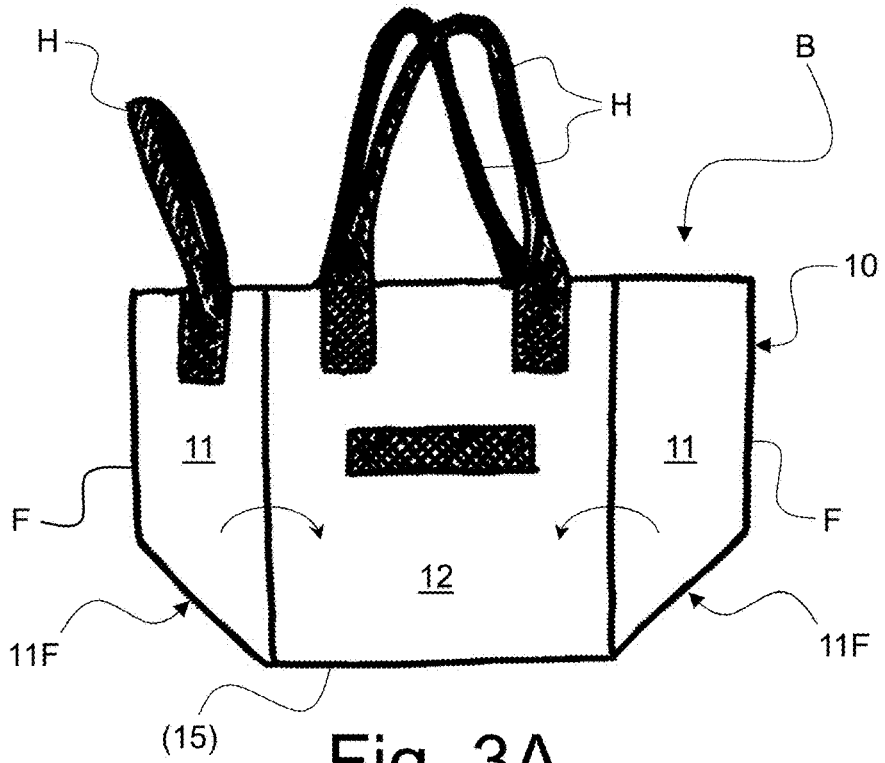
FIGS. 3A and 3B are schematic illustration of the rolling tote bag of FIGS. 1 and 2A-D partially folded into a flattened configuration as shown from two opposite sides.
Figure 3B:
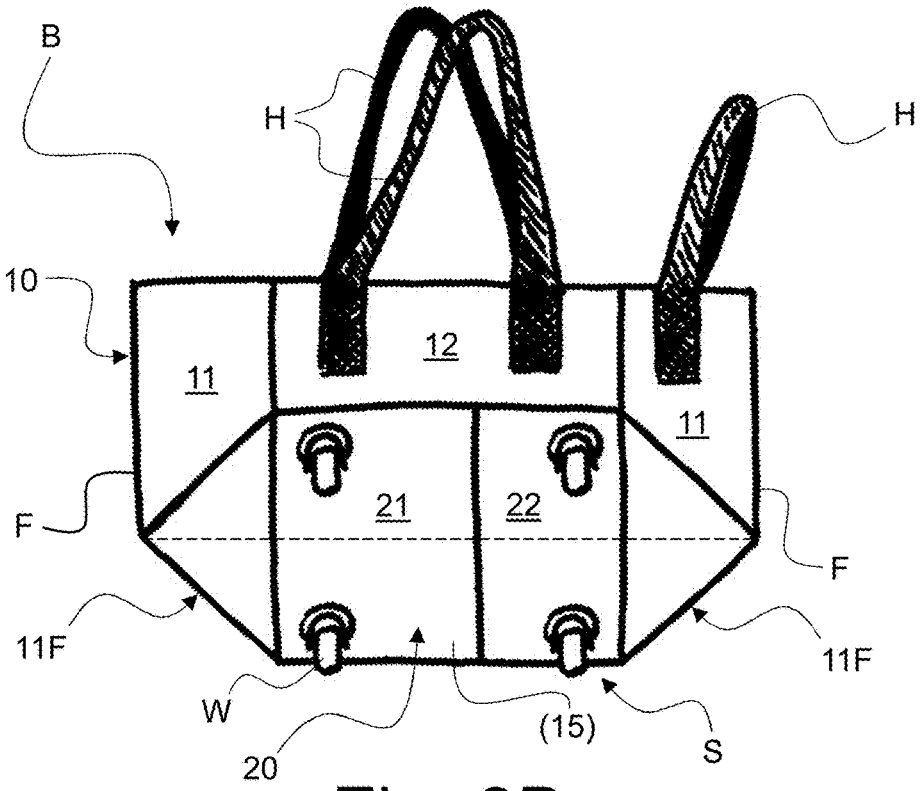

The collapsible container body 10 advantageously retains the ability to be foldable into a flattened configuration and each of the opposite short side panels 11 may advantageously be provided with a gusset fold F designed to allow outward folding of the opposite short side panels 11, as shown schematically in FIGS. 3A and 3B, into flat-folded gusset sections 11F. Such flat-folded gusset sections 11F may conveniently be folded inward over lateral sections of one of the long side panels 12, as indicated schematically by the pair of arrows in FIG. 3A, while the second, opposite long side panel 12 of the collapsible container body 10, is folded inward, along a horizontal fold, to align the bottom panel 15 and associated rolling support assembly S with the second long side panel, as shown in FIG. 3B.

In contrast to the known solution disclosed in International (PCT) Publication No. WO 2014/068545 A1 and related U.S. Pat. No. 9,999,282 B2, the removable rolling support assembly S is not inserted inside the inner storage volume and removably attached therein, but is rather positioned outside the inner storage volume. More specifically, the collapsible container body 10 further comprises a retaining structure 20 formed of multiple releasable fabric panels 21, 22, 31, 32, which retaining structure 20 is provided underneath the bottom panel 15 and is configured to releasably and securely hold the support plate P outside the inner storage volume against an underside of the bottom pale 15. More specifically, in the illustrated example, the retaining structure 20 includes a plurality of releasable securing flaps 21, 22, 31, 32, as shown in FIGS. 2A-D, that are provided about a periphery of the bottom panel 15. These securing flaps 21, 22, 31, 32 are configured to be releasably attachable to securely hold the support plate P of the rolling support assembly S against an underside of the bottom panel 15.

More specifically, in the illustrated embodiment, first and second releasable securing flaps 21, 22 are attached to and positioned along opposite lateral ends of the bottom panel 15, namely, along opposite short ends of the bottom panel 15 that coincide with the short side panels 11. These first and second securing flaps 21, 22 are partially overlapping at a distal end and mutually cooperate to encase the support plate P between the bottom panel 15 and the first and second securing flaps 21, 22. In this example, the first and second securing flaps 21, 22 jointly cover most of the underside of the collapsible container body 10 and of the rolling support assembly S, with the exception of the areas where the caster wheels W are provided.

In the illustrated example, a pair of apertures 21*a*, resp. 22*a*, is formed in each of the first and second securing flaps 21, 22 to allow passage of the four caster wheels W. In other embodiments, the first and second securing flaps 21, 22 could alternatively be provided with cutouts in the areas where the caster wheels W are provided.

Figure 2A:
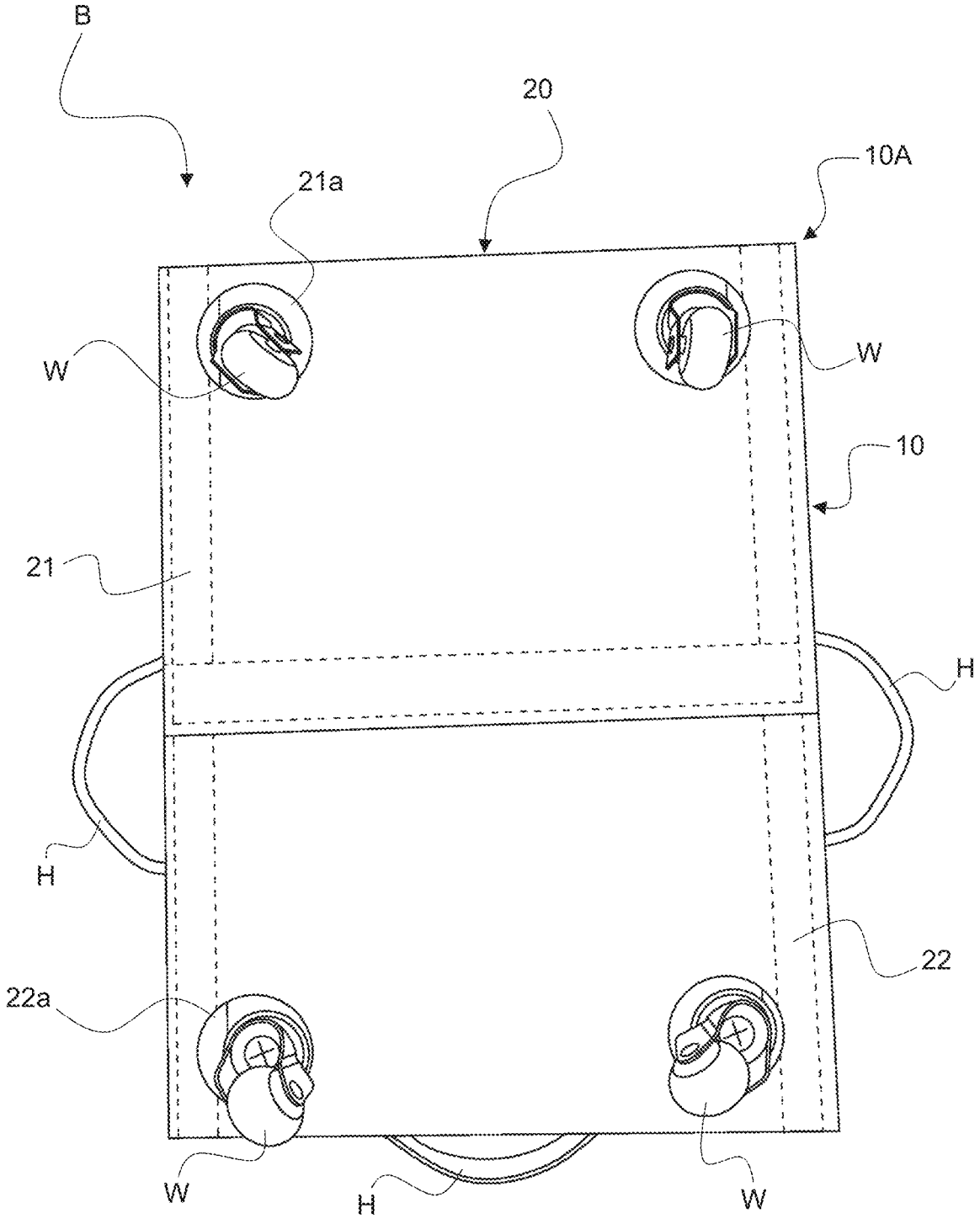
FIG. 2A is a photographic illustration of the underside of the rolling tote bag of FIG. 1.
Figure 2B:
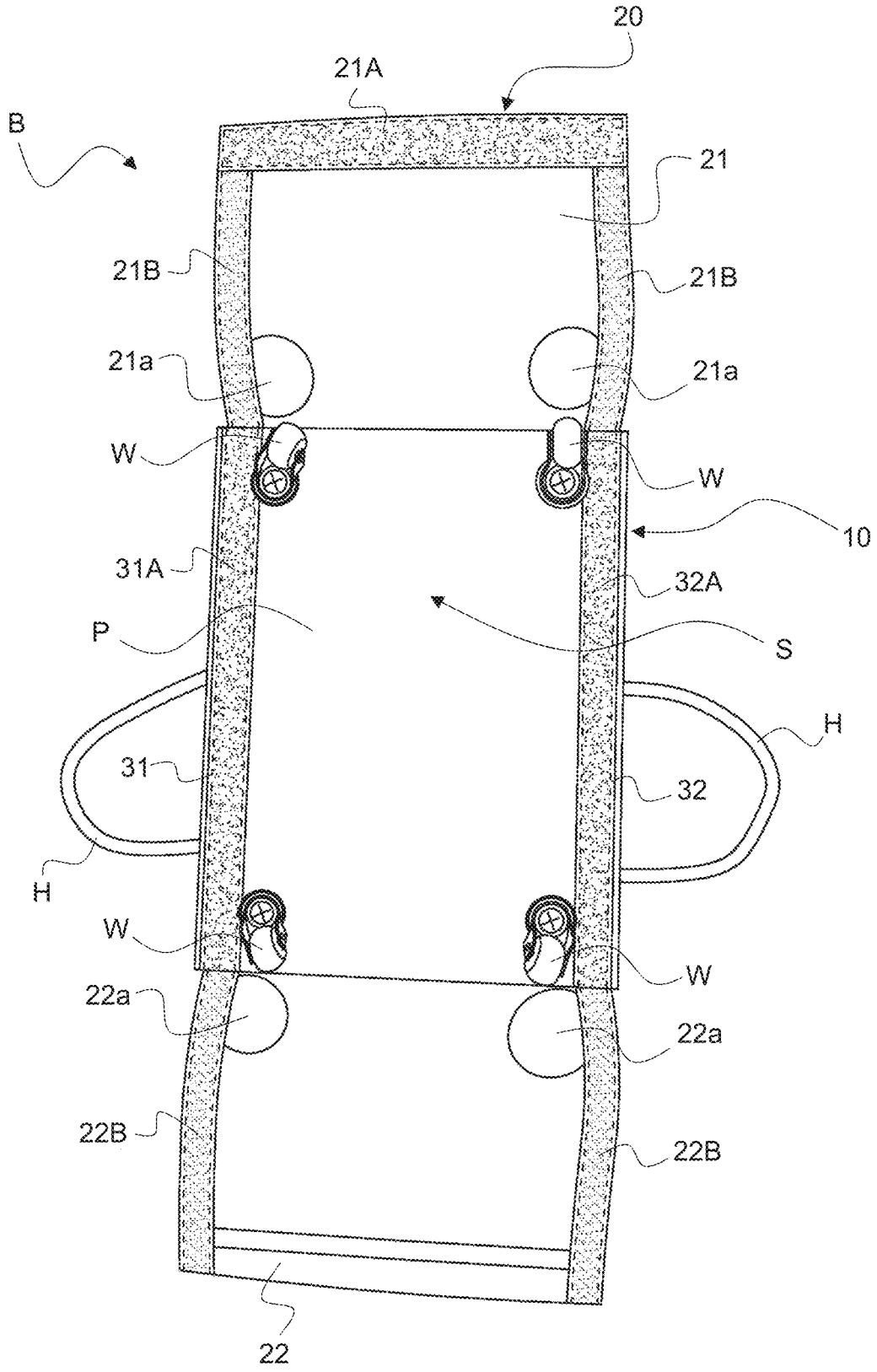
FIG. 2B is a photographic illustration of the underside of the rolling tote bag of FIGS. 1 and 2A, showing first and second releasable securing flaps in a detached state, revealing a rolling support assembly of the rolling tote bag.
Figure 2C:
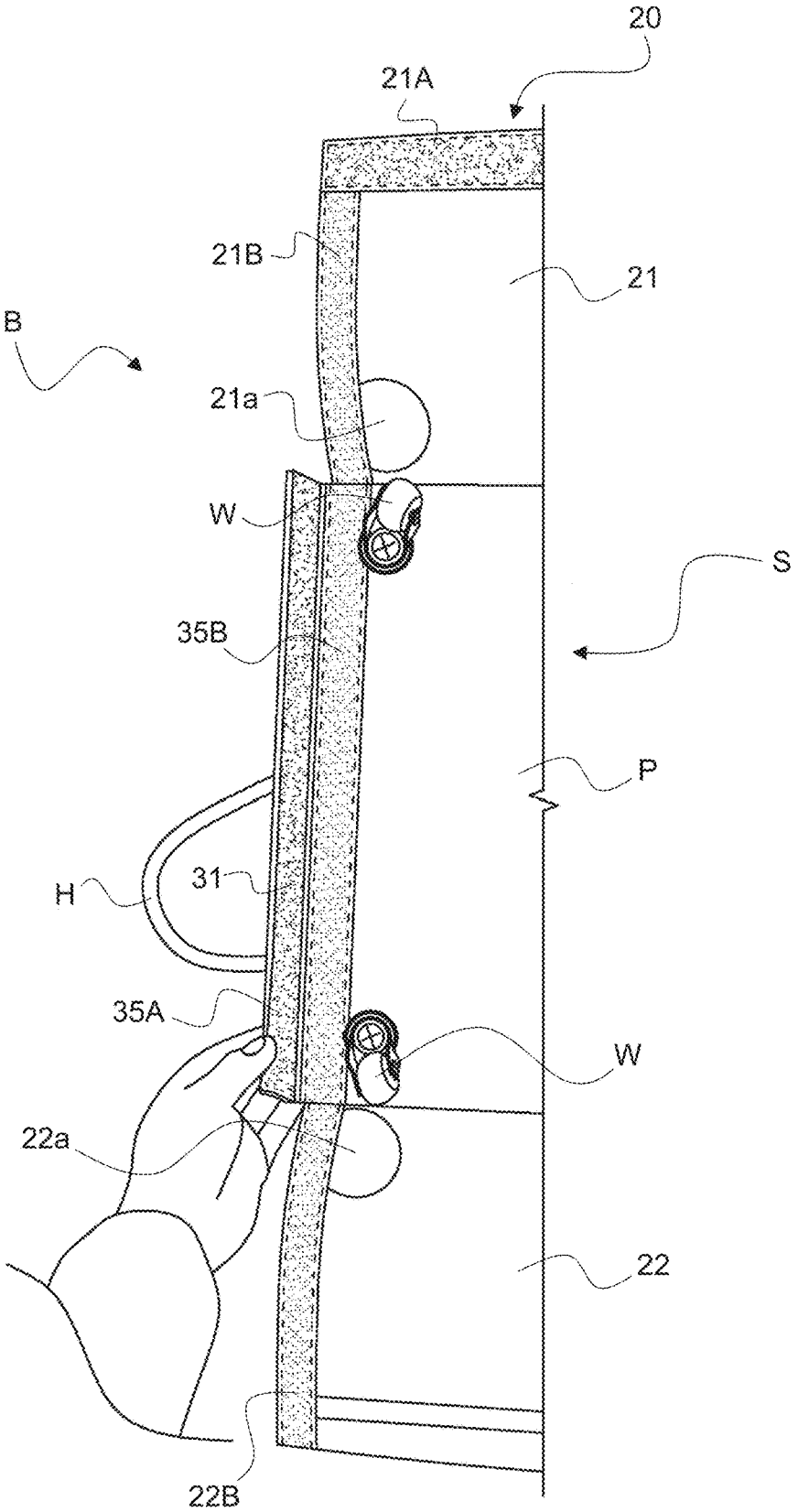
FIG. 2C is a photographic illustration of a left part of the underside of the rolling tote bag of FIGS. 1 and 2A-B, showing a third releasable securing flap in a detached state, revealing fastening elements provided along a longitudinal end section of the support plate of the rolling support assembly.
Figure 2D:
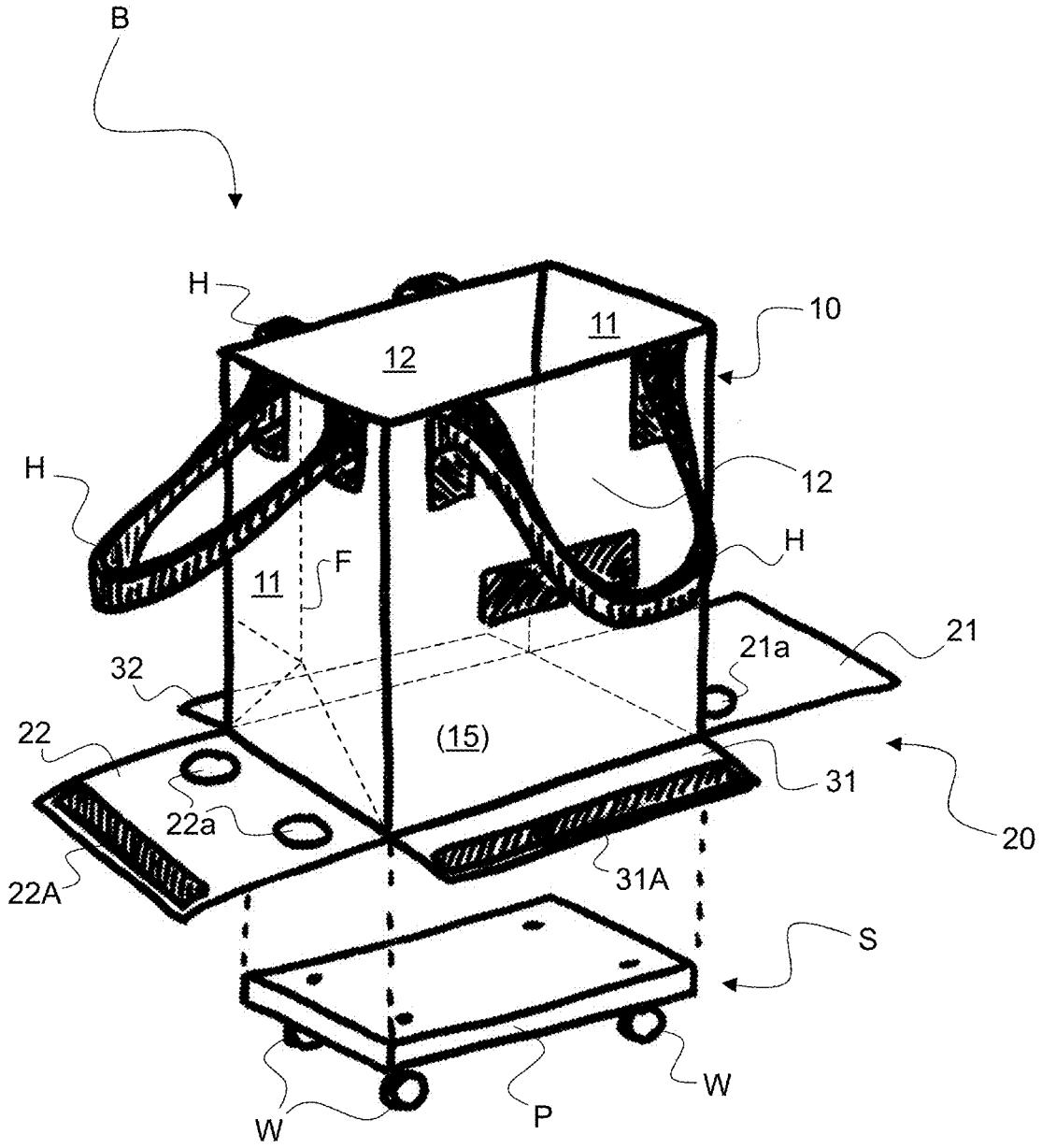
FIG. 2D is a schematic illustration of the rolling tote bag of FIGS. 1 and 2A-C showing the collapsible container body of the rolling tote bag in an expanded state, detached from the rolling support assembly.

As shown in FIGS. 2B and 2C, a distal end section of the first securing flap 21 is provided with a first fastening element 21A positioned on an inner side of the first securing flap 21. Similarly, as shown in FIG. 2D, a distal end section of the second securing flap 22 is provided with a complementary, second fastening element 22A that is positioned on an outer side of the second securing flap 22 for releasable cooperation with the first fastening elements 21A. In the illustrated embodiment, the fastening elements 21A, 22A are hook-and-loop fasteners that form fastening strips extending over substantially the whole width of the securing flaps 21, 22.

In the illustrated embodiment, as shown in FIGS. 2B and 2C, one may appreciate that longitudinal end sections of the first and second securing flaps 21, 22 are further provided with inner fastening elements 21B, 22B that are designed to provide for additional attachment to underlying elements. In this particular case, the retaining structure 20 further includes third and fourth releasable securing flaps 31, 32 that are attached to and positioned along opposite longitudinal ends of the bottom panel 15, namely, along opposite long ends of the bottom panel 15 that coincide with the long side panels 12. These third and fourth securing flaps 31, 32 are provided to hold corresponding longitudinal end sections of the support plate P and, as shown in FIG. 2C, are each provided with an inner fastening element 35A positioned on an inner side thereof and configured to releasably cooperate with a corresponding complimentary fastening element 35B provided on each opposite longitudinal end section of the support plate P. As shown in FIGS. 2B and 2D, each of the third and fourth securing flaps 31, 32 is further provided with an outer fastening element 31A, resp. 32A, positioned on an outer side thereof, for releasable cooperation with the aforementioned inner fastening elements 21B, 22B. This ensures adequate attachment of the support plate P against the underside of the bottom panel 15, the support plate P being securely held in place by the securing flaps 21, 22, 31, 32.

In the illustrated embodiment, fastening elements 21B, 22B, 31A, 32A, 35A and 35B are likewise hook-and-loop fasteners that form fastening strips extending over substantially the entire desired attachment zone.

The aforementioned securing flaps 21, 22, 31, 32 may be made of any suitable fabric material, such as but not limited to woven fabric produced out of strands of synthetic or non-synthetic material, especially polypropylene strands.

In other embodiments, the third and fourth securing flaps 31, 32 could possibly be omitted, with the inner fastening elements 21B, 22B being brought to cooperate directly with the fastening elements 35B provided on the longitudinal end sections of the support plate P. This would however expose edges of the support plate P along the long sides, which is not necessarily desirable. Use of the four securing flaps 21, 22, 31, 32 is therefore preferred in practice.

In the embodiment shown in FIGS. 1 to 3A-B, one will appreciate that the first and second securing flaps 21, 22 are dimensioned to at least party cover the third and fourth securing flaps 31, 32, as well as the underlying rolling support assembly S, when in the assembled state.

Figure 4A:
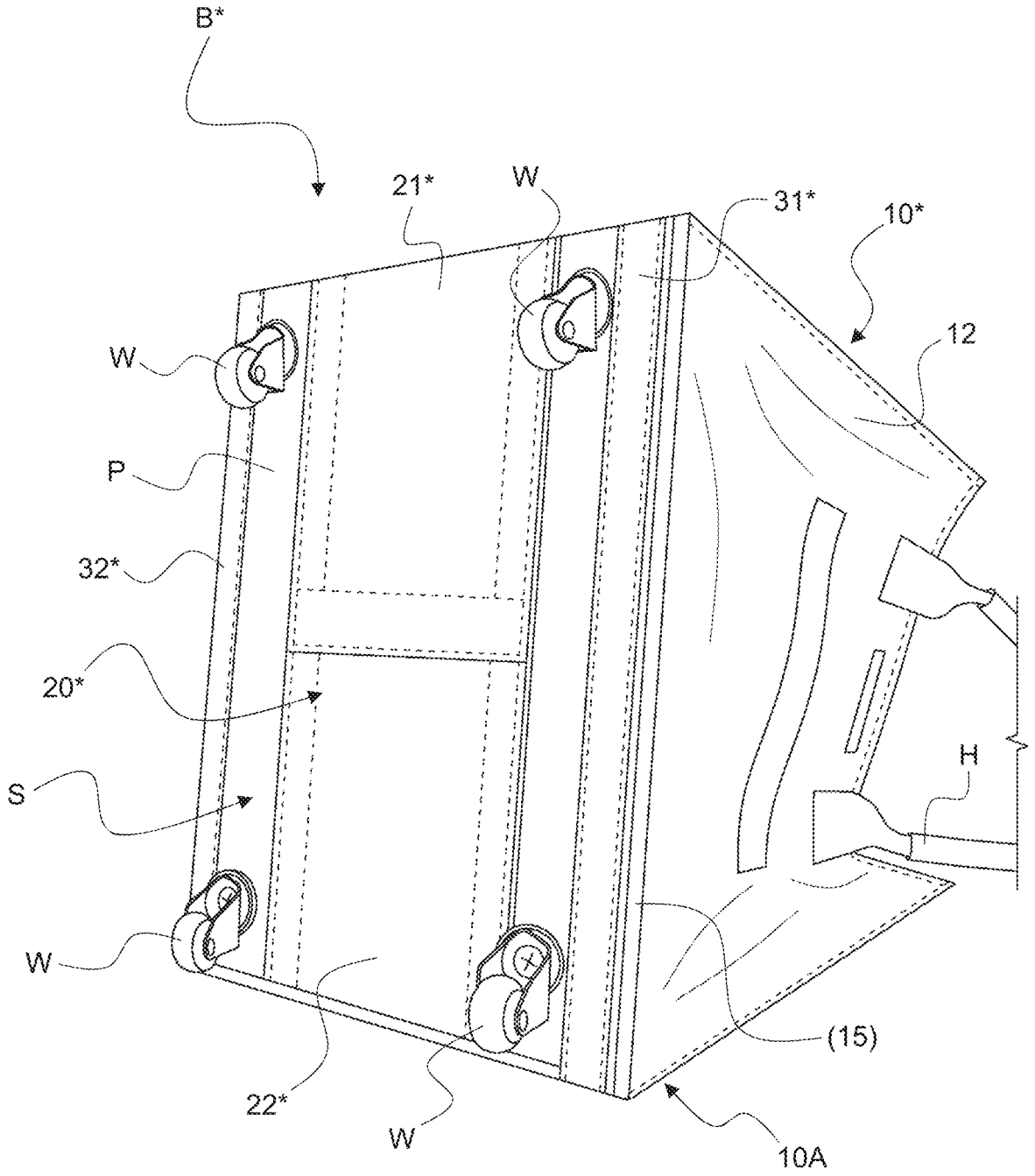
FIG. 4A is a photographic illustration of a rolling tote bag in accordance with a second embodiment of the invention.

FIG. 4A shows another embodiment of a rolling tote bag B* comprising a collapsible container body 10* that likewise comprises a retaining structure 20* including four releasable securing flaps, here designated by reference signs 21*, 22*, 31*, 32*, that are provided about a periphery of the bottom panel 15 to securely hold the support plate P of the rolling support assembly S against an underside of the bottom panel 15. In this other embodiment, the first and second releasable securing flaps 21*, 22* are dimensioned not to cover the third and fourth releasable securing flaps 31*, 32* and to leave spacings (here extending over the whole longitudinal length) that are positioned and dimensioned to accommodate passage of the caster wheels W. No apertures or cutouts in the first and second securing flaps 21*, 22* are required in this case, which especially allows to accommodate caster wheels W of a larger variety of sizes.

Figure 4B:
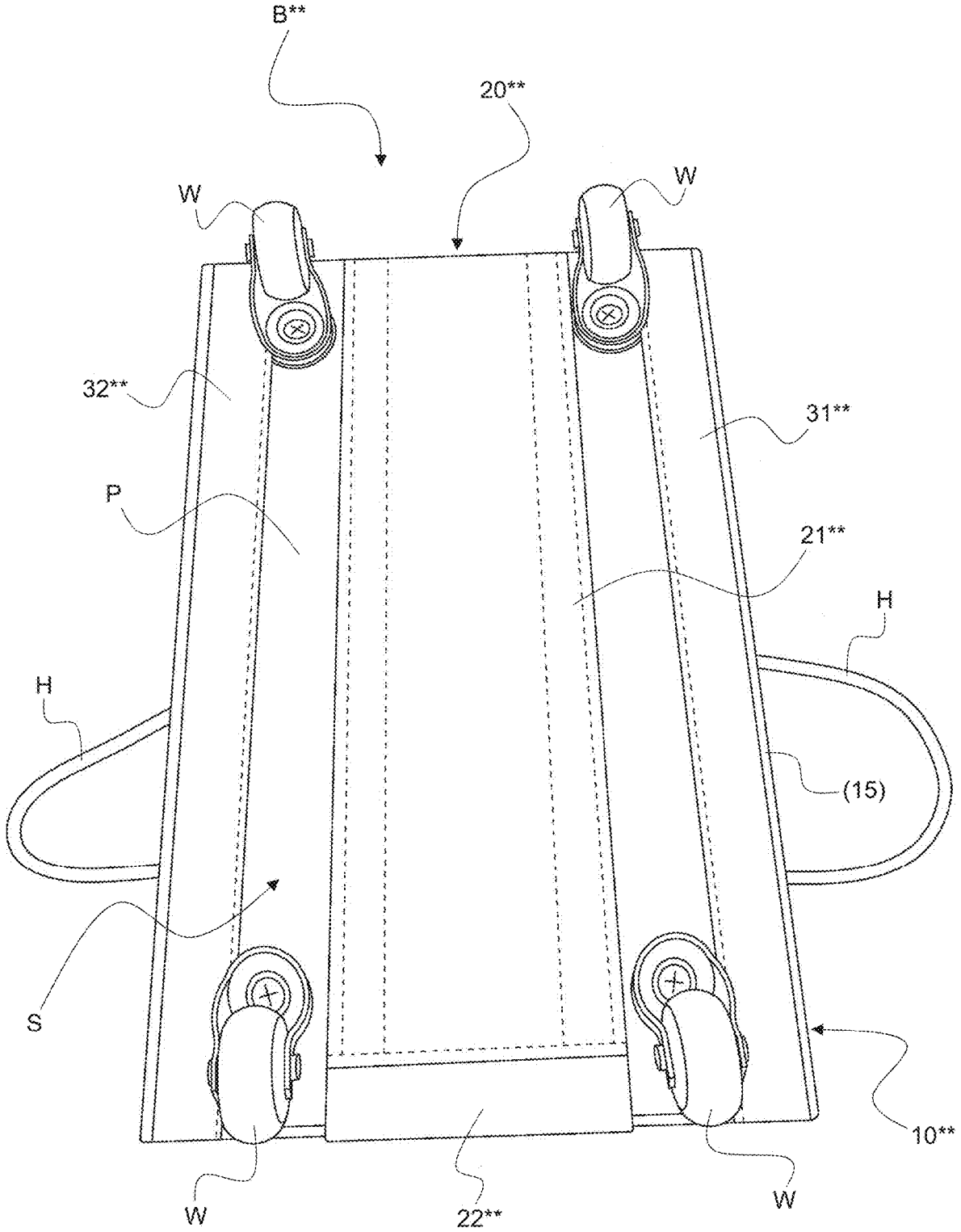
FIG. 4B is a photographic illustration of a rolling tote bag in accordance with a variant of the second embodiment of FIG. 4A.

FIG. 4B shows a variant of the embodiment shown in FIG. 4A in which the collapsible container body 10 of the rolling tote bag B comprises a retaining structure 20 that likewise including four releasable securing flaps, here designated by reference signs 21**, 22**, 31**, 32**, that are provided about a periphery of the bottom panel 15 to securely hold the support plate P of the rolling support assembly S against an underside of the bottom panel 15. According to this variant, the first and second releasable securing flaps 21**, 22** are similarly dimensioned not to cover the third and fourth releasable securing flaps 31**, 32** and to leave spacings (here extending over the whole longitudinal length) that are positioned and dimensioned to accommodate passage of the caster wheels W. A difference with respect to the embodiment of FIG. 4A resides in the fact that the first releasable securing flap 21** extends along substantially the entire length of the support plate P, while the second releasable securing flap 22** is shorter in length, such that the distal end sections of the first and second releasable securing flaps 21**, 22** are fastened to one another close to one side of the collapsible container body 10****.

The third and fourth releasable securing flaps 31*, 32*, resp. 31, 32** shown in FIGS. 4A and 4B are secured to the support plate P in the same manner as the third and fourth releasable securing flaps 31, 32, namely by means of a pair of fastening elements similar to fastening elements 35A, 35B shown in FIG. 2C. Corresponding pairs of fastening elements may likewise be provided to secure the first and/or second securing flaps 21*, 22*, resp. 21**, 22**** to the support plate P.

Figure 5:
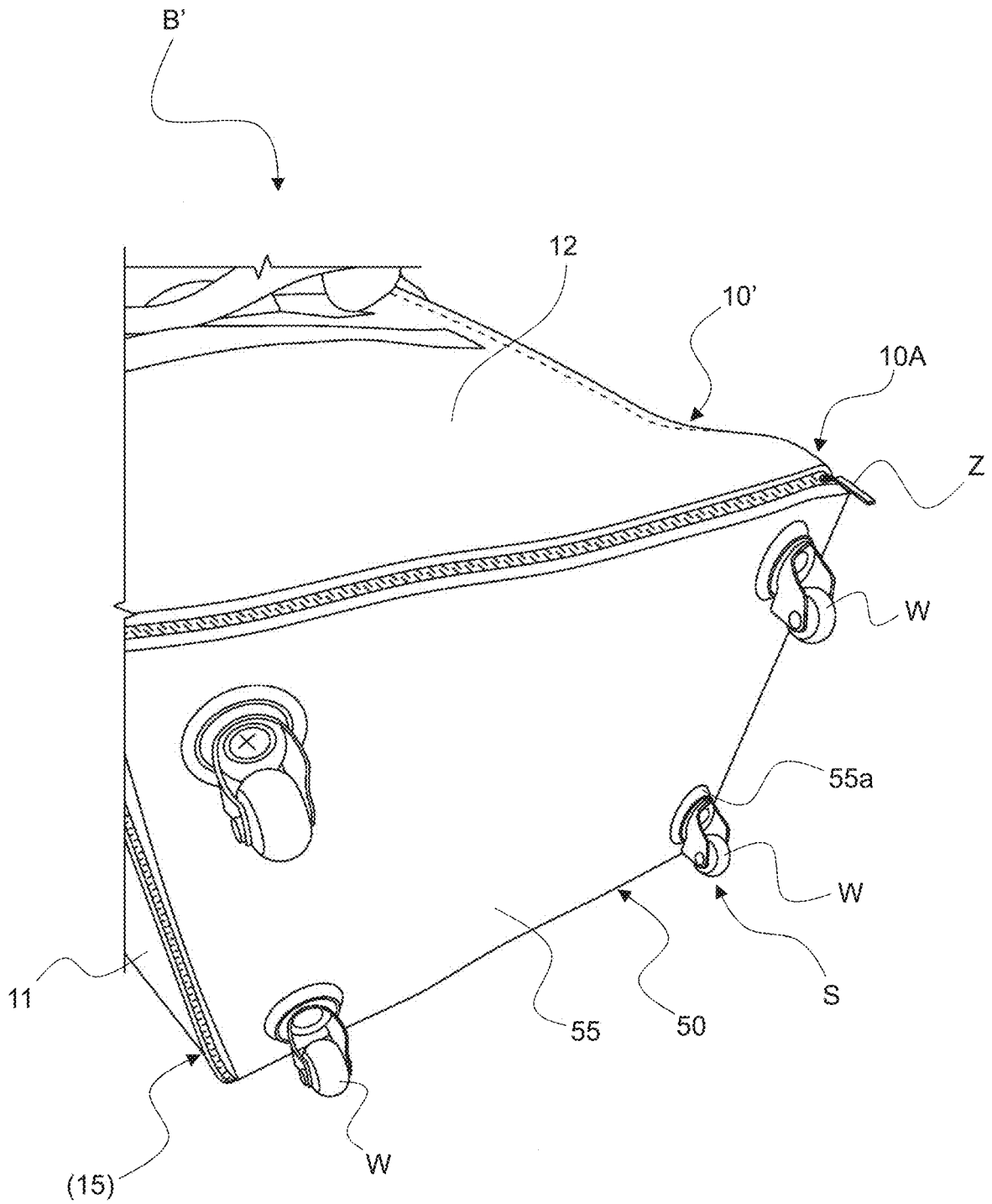
FIG. 5 is a photographic illustration of a rolling tote bag in accordance with yet another embodiment of the invention.

FIG. 5 shows yet another embodiment of a rolling tote bag B' comprising a collapsible container body 10' that likewise comprises a retaining structure 50 that is provided underneath the bottom panel 15 and is configured to releasably and securely hold the support plate P of the rolling support assembly S outside of the inner storage volume against the underside of the bottom panel 15. According to this embodiment, the retaining structure 50 includes a releasable retaining panel 55 (more than one releasable retaining panel being however possible) that is fastened to the collapsible container body 10' about a periphery of the bottom panel 15 to form a releasable retaining envelope underneath the bottom panel 15. This releasable retaining envelope is configured and dimensioned to receive the support plate P therein, while allowing passage of the caster wheels W through the retaining panel 55, as shown in FIG. 5. To this end, the retaining panel 55 is provided with four apertures 55*a* to all passage of the caster wheels W. The releasable retaining envelope is structured to take an open state (not shown), in which the retaining panel 55 is at least partly released from the collapsible container body 10' to allow the support plate P to be removed from or inserted into the releasable retaining envelope, and a closed state (shown in FIG. 5), in which the retaining panel 55 is fastened to the collapsible container body 10' to securely hold the support plate P within the releasable retaining envelope.

The releasable retaining panel 55 may likewise be made of any suitable fabric material, such as but not limited to woven fabric produced out of strands of synthetic or non-synthetic material, especially polypropylene strands.

More specifically, in the illustrated example, the retaining panel 55 is attached to and positioned along a first lateral end of the bottom panel 15, namely, along one short end of the bottom panel 15 that coincides with one of the short side panels 11, and a zipper Z is provided to releasably fasten the retaining panel 55 along the remaining portions of the periphery of the bottom panel 15. In this way, the releasable retaining envelope can selectively be opened by unzipping the zipper Z to allow insertion or removal of the support plate P. Conversely, upon zipping the zipper Z, the releasable retaining envelope can be closed around the support plate P to securely hold the support plate P therein.

As a further refinement, it may be contemplated to configure the collapsible container body 10, resp. 10*, to exhibit rounded corners 10A, which will improve resistant to wear and tear at the four bottom corners.

Various modifications and/or improvements may be made to the above-described embodiments without departing from the scope of the invention as defined by the appended claims. For instance, while hook-and-loop fasteners are preferred, one could possibly contemplate using other suitable fastening elements, including e.g. a plurality of snap fasteners distributed along the desired attachment zones, or even zippers.

Furthermore, in all of the aforementioned embodiments, the relevant retaining structure is preferably realized in such a way as to be releasable and allow removal of the rolling support assembly. In other embodiments, the retaining structure could be designed to permanently hold the rolling support assembly, in which case the relevant securing flaps or retaining panel(s) may for instance be stitched, glued or otherwise attached to one another. Use of a releasable retaining structure is however preferred from a practical perspective.

LIST OF REFERENCE NUMERALS AND SIGNS USED THEREIN

B rolling tote bag (first embodiment)
B* rolling tote bag (second embodiment)
B** rolling tote bag (variant of second embodiment)
B' rolling tote bag (third embodiment)
10 collapsible (foldable) container body of rolling tote bag B
10* collapsible (foldable) container body of rolling tote bag B*
10 collapsible (foldable) container body of rolling tote bag B
10' collapsible (foldable) container body of rolling tote bag B'
10A corners of collapsible container body 10, 10*, 10 resp. 10' formed at junctions between side panels 11, 12/corners of bottom panel 15**
11 opposite side panels of collapsible container body 10, 10*, 10 resp. 10'** (short side panels)
F gusset fold formed on each side panel 11
11F flat-folded gusset sections formed by outward folding of side panels 11 along gusset fold F
12 opposite side panels of collapsible container body 10, 10*, 10 resp. 10'** (long side panels)
15 bottom panel of collapsible container body 10, 10*, 10 resp. 10'**
S rolling support assembly removably attached to bottom side of collapsible container body 10, 10*, 10 resp. 10'**
P support plate
W caster wheels provided on underside of support plate P
H handles
20 retaining structure formed of releasable fabric panels 21, 22, 31, 32 (first embodiment)
20* retaining structure formed of releasable fabric panels 21*, 22*, 31*, 32* (second embodiment)
20* retaining structure formed of releasable fabric panels 21, 22**, 31**, 32**** (variant of second embodiment)
21 first releasable securing flap provided along first short side of bottom panel 15
21*a* apertures provided in first securing flap 21 allowing passage of caster wheels W
21* first releasable securing flap provided along first short side of bottom panel 15
21 first releasable securing flap provided along first short side of bottom panel 15**
21A first fastening element (e.g. hook-and-loop fastener) positioned on inner side of the first securing flap 21, 21*, resp. 21, at distal end section thereof for cooperation with second fastening element 22**A
21B inner fastening elements provided on inner side of first securing flap 21, along longitudinal end sections thereof, for cooperation with outer fastening elements 31A, 31B
22 second releasable securing flap provided along second short side of bottom panel 15, opposite first securing flap 21
22*a* apertures provided in second securing flap 22 allowing passage of caster wheels W
22* second releasable securing flap provided along second short side of bottom panel 15, opposite first securing flap 21*
22 second releasable securing flap provided along second short side of bottom panel 15, opposite first securing flap 21****
22A second fastening element (e.g. hook-and-loop fastener) positioned on outer side of second securing flap 22, 22*, resp. 22, at distal end section thereof, for cooperation with first fastening element 21**A
22B inner fastening elements provided on inner side of second securing flap 22, along longitudinal end sections thereof, for cooperation with outer fastening elements 31A, 31B
31 third releasable securing flap provided along first long side of bottom panel 15
31A outer fastening element (e.g. hook-and-loop fastener) positioned on outer side of third securing flap 31 for cooperation with inner fastening elements 21B, 22B
31* third releasable securing flap provided along first long side of bottom panel 15
31 third releasable securing flap provided along first long side of bottom panel 15**
32 fourth releasable securing flap provided along second long side of bottom panel 15, opposite third securing flap 31
32A outer fastening element (e.g. hook-and-loop fastener) positioned on outer side of fourth securing flap 32 for cooperation with inner fastening elements 21B, 22B
32* fourth releasable securing flap provided along second long side of bottom panel 15, opposite third securing flap 31*

32 fourth releasable securing flap provided along second long side of bottom panel 15, opposite third securing flap 31****

35A inner fastening elements (e.g. hook-and-loop fastener) positioned on inner side of third and fourth securing flaps 31, 32, 31*, 32*, resp. 31, 32**, for cooperation with fastening elements 35**B

35B fastening elements (e.g. hook-and-loop fastener) provided along opposite longitudinal end sections of support plate P for cooperation with the inner fastening elements 35A

50 retaining structure formed of releasable fabric panel 55 (third embodiment)

55 releasable retaining panel fastened to collapsible container body 10' about periphery of bottom panel 15 to form releasable retaining envelope underneath bottom panel 15

Z zipper

The invention claimed is:

1. A rolling tote bag comprising a collapsible container body made of a foldable assembly of fabric panels, including a bottom panel and side panels, that jointly define an inner storage volume when in an expanded state, wherein the rolling tote bag further comprises a rolling support assembly to provide rolling support for the collapsible container body in the expanded state, the rolling support assembly including a support plate and a plurality of caster wheels provided on an underside of the support plate, wherein the collapsible container body further comprises a retaining structure formed of one or more fabric panels, which retaining structure is provided underneath the bottom panel and is configured to securely hold the support plate outside of the inner storage volume against an underside of the bottom panel, wherein the retaining structure includes first and second releasable securing flaps attached to and positioned along opposite lateral ends of the bottom panel, wherein the first and second releasable securing flaps are partially overlapping and releasably attachable to one another to encase the support plate between the bottom panel and the first and second releasable securing flaps, wherein a distal end section of the first releasable securing flap is provided with a first fastening element positioned on an inner side of the first releasable securing flap, wherein a distal end section of the second releasable securing flap is provided with a complementary, second fastening element positioned on an outer side of the second releasable securing flap for releasable cooperation with the first fastening element, wherein the retaining structure further includes third and fourth releasable securing flaps attached to and positioned along opposite longitudinal ends of the bottom panel to hold corresponding longitudinal end sections of the support plate, wherein each of the third and fourth releasable securing flaps is provided with an inner fastening element positioned on an inner side thereof, and wherein opposite longitudinal end sections of the support plate are each provided with a complementary fastening element for releasable cooperation with a corresponding one of the inner fastening elements.

2. The rolling tote bag according to claim 1, wherein the first and second releasable securing flaps are dimensioned to at least partly cover the third and fourth releasable securing flaps when in an assembled state, wherein each of the third and fourth releasable securing flaps is further provided with an outer fastening element positioned on an outer side thereof, and wherein longitudinal end sections of each of the first and second releasable securing flaps are each further provided with a complementary, inner fastening element for releasable cooperation with a corresponding one of the outer fastening elements.

3. The rolling tote bag according to claim 2, wherein each of the first and second releasable securing flaps is provided with one or more apertures positioned and dimensioned to allow passage of the caster wheels therethrough, and/or wherein each of the first and second releasable securing flaps is provided with one or more cutouts in areas where the caster wheels are located.

4. The rolling tote bag according to claim 1, wherein the first and second releasable securing flaps are dimensioned not to cover the third and fourth releasable securing flaps and to leave spacings that are positioned and dimensioned to accommodate passage of the caster wheels.

5. The rolling tote bag according to claim 1, wherein the fastening elements consist of hook-and-loop fasteners.

6. The rolling tote bag according to claim 1, wherein the first and second releasable securing flaps are positioned along opposite short ends of the bottom panel.

7. The rolling tote bag according to claim 1, wherein the first and second releasable securing flaps are positioned along opposite short ends of the bottom panel, and wherein the third and fourth releasable securing flaps are positioned along opposite long ends of the bottom panel.

8. The rolling tote bag according to claim 1, wherein the collapsible container body is configured to exhibit rounded corners.

9. The rolling tote bag according to claim 1, wherein the side panels are each made of at least two outer pieces of fabric and an intermediate piece of bubble wrap interposed between the two outer pieces of fabric.

10. A rolling tote bag comprising a collapsible container body made of a foldable assembly of fabric panels, including a bottom panel and side panels, that jointly define an inner storage volume when in an expanded state, wherein the rolling tote bag further comprises a rolling support assembly to provide rolling support for the collapsible container body in the expanded state, the rolling support assembly including a support plate and a plurality of caster wheels provided on an underside of the support plate, wherein the collapsible container body further comprises a retaining structure formed of one or more fabric panels, which retaining structure is provided underneath the bottom panel and is configured to securely hold the support plate outside of the inner storage volume against an underside of the bottom panel, wherein the side panels are each made of at least two outer pieces of fabric and an intermediate piece of bubble wrap interposed between the two outer pieces of fabric, and wherein the outer pieces of fabric are made of or comprise at least one sheet of woven fabric produced out of strands of synthetic or non-synthetic material, such as polypropylene strands.

11. The rolling tote bag according to claim 10, wherein one or each of the outer pieces of fabric further comprises a laminated film, such as a BOPP film, that is laminated on an outer side of the sheet of woven fabric.

12. The rolling tote bag according to claim 1, wherein opposite short side panels of the collapsible container body are each provided with a gusset fold designed to allow outward folding of the opposite short side panels into flat-folded gusset sections.

13. A rolling tote bag comprising a collapsible container body made of a foldable assembly of fabric panels, including a bottom panel and side panels, that jointly define an inner storage volume when in an expanded state, wherein the rolling tote bag further comprises a rolling support assembly to provide rolling support for the collapsible container body in the expanded state, the rolling support assembly including a support plate and a plurality of caster wheels provided on an underside of the support plate, wherein the collapsible container body further comprises a retaining structure formed of one or more fabric panels, which retaining structure is provided underneath the bottom panel and is configured to securely hold the support plate outside of the inner storage volume against an underside of the bottom panel, wherein opposite short side panels of the collapsible container body are each provided with a gusset fold designed to allow outward folding of the opposite short side panels into flat-folded gusset sections, and wherein the collapsible container body is configured to be foldable into a flattened configuration where the opposite short side panels are folded outward along the gusset fold into the flat-folded gusset sections, which flat-folded gusset sections are foldable inward over lateral sections of a first long side panel of the collapsible container body, while a second long side panel of the collapsible container body, opposite the first long side panel, is foldable inward to align the bottom panel and associated rolling support assembly with the second long side panel.

14. A rolling tote bag comprising a collapsible container body made of a foldable assembly of fabric panels, including a bottom panel and side panels, that jointly define an inner storage volume when in an expanded state, wherein the rolling tote bag further comprises a rolling support assembly to provide rolling support for the collapsible container body in the expanded state, the rolling support assembly including a support plate and a plurality of caster wheels provided on an underside of the support plate, wherein the collapsible container body further comprises a retaining structure formed of one or more fabric panels, which retaining structure is provided underneath the bottom panel and is configured to securely hold the support plate outside of the inner storage volume against an underside of the bottom panel, wherein the retaining structure includes at least one releasable retaining panel fastened to the collapsible container body about a periphery of the bottom panel to form a releasable retaining envelope underneath the bottom panel, which releasable retaining envelope is configured and dimensioned to receive the support plate therein, while allowing passage of the caster wheels through the at least one releasable retaining panel, and wherein the releasable retaining envelope is structured to take an open state, in which the at least one releasable retaining panel is at least partly released from the collapsible container body to allow the support plate to be removed from or inserted into the releasable retaining envelope, and a closed state, in which the at least one releasable retaining panel is fastened to the collapsible container body to securely hold the support plate within the releasable retaining envelope.

15. The rolling tote bag according to claim 14 wherein the retaining structure includes a zipper to selectively close the releasable retaining envelope around the support plate or open the releasable retaining envelope to allow insertion or removal of the support plate.

16. The rolling tote bag according to claim 14, wherein the collapsible container body is configured to exhibit rounded corners.

17. The rolling tote bag according to claim 14, wherein the side panels are each made of at least two outer pieces of fabric and an intermediate piece of bubble wrap interposed between the two outer pieces of fabric.

18. The rolling tote bag according to claim 17, wherein the outer pieces of fabric are made of or comprise at least one sheet of woven fabric produced out of strands of synthetic or non-synthetic material, such as polypropylene strands.

19. The rolling tote bag according to claim 18, wherein one or each of the outer pieces of fabric further comprises a laminated film, such as a BOPP film, that is laminated on an outer side of the sheet of woven fabric.

20. The rolling tote bag according to claim 14, wherein opposite short side panels of the collapsible container body are each provided with a gusset fold designed to allow outward folding of the opposite short side panels into flat-folded gusset sections.

21. The rolling tote bag according to claim 20, wherein the collapsible container body is configured to be foldable into a flattened configuration where the opposite short side panels are folded outward along the gusset fold into the flat-folded gusset sections, which flat-folded gusset sections are foldable inward over lateral sections of a first long side panel of the collapsible container body, while a second long side panel of the collapsible container body, opposite the first long side panel, is foldable inward to align the bottom panel and associated rolling support assembly with the second long side panel.

* * * * *